US008245319B2

(12) United States Patent
Neal

(10) Patent No.: US 8,245,319 B2
(45) Date of Patent: Aug. 21, 2012

(54) LIGHTWEIGHT FABRIC BASED BODY ARMOR

(75) Inventor: Murray L. Neal, Fresno, CA (US)

(73) Assignee: American Development Group International, LLC, Washington, DC (US)

( * ) Notice: Subject to any disclaimer, the term of this patent is extended or adjusted under 35 U.S.C. 154(b) by 1493 days.

(21) Appl. No.: 10/238,096

(22) Filed: Sep. 10, 2002

(65) Prior Publication Data

US 2012/0180176 A1 Jul. 19, 2012

(51) Int. Cl.
*F41H 1/02* (2006.01)
*F41H 1/00* (2006.01)
*F41H 13/00* (2006.01)

(52) U.S. Cl. ..... 2/2.5; 89/36.05

(58) Field of Classification Search ..... 2/2.5, 455, 2/456, 463, 467; 428/911, 340; 442/246, 442/286, 390, 297, 298, 255, 269, 301, 333, 442/366; 89/36.01, 36.02, 36.05
See application file for complete search history.

(56) References Cited

U.S. PATENT DOCUMENTS 2,747,190 A * 5/1956 Foster ..... 2/2.5
3,452,362 A * 7/1969 Korolick et. al. ..... 2/2.5
3,641,638 A * 2/1972 Laible ..... 28/112
4,287,607 A * 9/1981 Leach ..... 2/2.5
5,200,263 A * 4/1993 Gould et al. ..... 428/323
5,514,241 A * 5/1996 Gould et al. ..... 156/261
5,724,670 A * 3/1998 Price ..... 2/2.5
5,926,842 A * 7/1999 Price et al. ..... 2/2.5
5,943,694 A * 8/1999 Moureaux et al. ..... 2/2.5
5,960,470 A * 10/1999 Bachner, Jr. ..... 2/2.5
6,026,509 A * 2/2000 Bachner, Jr. ..... 2/2.5
6,035,438 A * 3/2000 Neal et al. ..... 2/2.5
6,047,399 A * 4/2000 Bachner, Jr. ..... 2/2.5
6,127,291 A * 10/2000 Coppage et al. ..... 442/135
6,151,710 A * 11/2000 Bachner, Jr. ..... 2/2.5
6,170,378 B1 * 1/2001 Neal et al. ..... 89/36.05
6,195,798 B1 * 3/2001 Bachner, Jr. ..... 2/2.5
6,219,842 B1 * 4/2001 Bachner, Jr. ..... 2/2.5
6,240,557 B1 * 6/2001 Bachner, Jr. ..... 2/2.5
6,266,819 B1 * 7/2001 Bachner, Jr. ..... 2/2.5
6,370,690 B1 * 4/2002 Neal ..... 2/2.5
6,449,769 B1 * 9/2002 Bachner, Jr. ..... 2/2.5
6,510,777 B2 * 1/2003 Neal ..... 89/36.05
6,559,079 B1 * 5/2003 Bachner, Jr. ..... 442/246
6,562,435 B1 * 5/2003 Brillhart et al. ..... 428/105
6,627,562 B1 * 9/2003 Gehring, Jr. ..... 442/35
6,647,856 B1 * 11/2003 Neal ..... 89/36.02
6,684,404 B2 * 2/2004 Bachner et al. ..... 2/2.5
6,703,104 B1 * 3/2004 Neal ..... 428/118
6,705,197 B1 * 3/2004 Neal ..... 89/36.05
6,737,368 B2 * 5/2004 Chiou ..... 442/134
6,745,661 B1 * 6/2004 Neal et al. ..... 89/36.02
6,753,274 B2 * 6/2004 Kim ..... 442/38
2002/0073473 A1 * 6/2002 Bachner et al. ..... 2/2.5
2004/0016036 A1 * 1/2004 Bachner, Jr. ..... 2/2.5
2004/0023580 A1 * 2/2004 Hand et al. ..... 442/134
2004/0048538 A1 * 3/2004 Granqvist et al. ..... 442/181

* cited by examiner

*Primary Examiner* — Bobby Muromoto, Jr.
(74) *Attorney, Agent, or Firm* — Blakely, Sokoloff, Taylor & Zafman, LLP

(57) ABSTRACT

Stab resistant garment having layers of multi-ply stab resistant fabric connected together such that a layer is stitched together, but individual layers are attached by bar tacking. This provides a mixture of stiff resistance and free play in the structure of the garment that prevents penetration by sharp implements including bladed weapons.

19 Claims, 6 Drawing Sheets

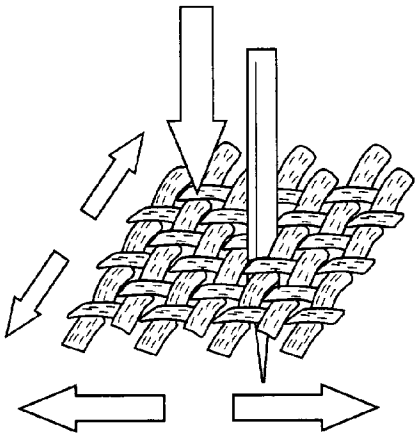
FIG. 1A
FIG. 1B
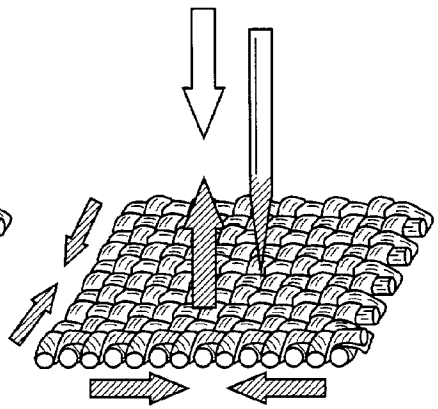
FIG. 1C
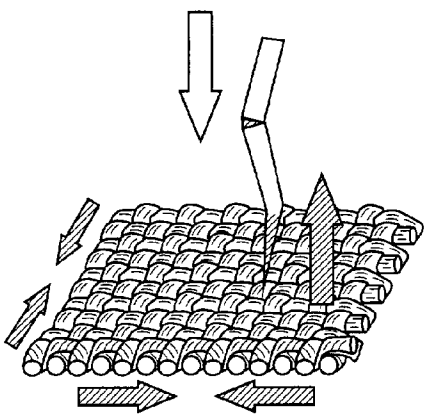
FIG. 1D

LIGHTWEIGHT FABRIC BASED BODY ARMOR

BACKGROUND OF THE INVENTION

1. Field of the Invention

The invention relates to fabric based body armor. More specifically, the invention relates to fabric based body armor capable of defeating multiple threats.

2. Background of the Invention

There has long been the need for body armor designed for resistance to penetration from sharp pointed implements such as ice picks, awls, other man made improvised devices primarily designed for stabbing and single and double edged blades for both stabbing and slashing into the body causing severe injury, disability or even death. Prior penetration resistant armors provide good levels of protection, but allow some penetration through the armor. These armors do not allow penetration by sharp pointed implements far enough into the torso cavity to engage and perforate any major organs such that the penetration would be fatal. The major organs that are most commonly identified as requiring protection are the heart, liver, kidneys, spleen and sometimes the spine. An attack from the posterior requires less penetration from the sharpened implement to damage a major organ. This is especially true in the case of the spine. Additionally, there are other vital elements of the body that, if penetrated, would result in a fatality. These areas are also often covered by body armor. These additional areas include the neck.

Current penetration test protocol and procedural tests generally allow for some level of penetration. These levels of penetration allow up to one inch of the implement to completely penetrate the body armor. This degree of penetration would be catastrophic if the penetration were through a major artery or the spinal column. A penetration, tearing through the arterial walls can cause profuse bleeding that is not easily stopped. A penetration into the spinal column can cause partial or complete paralysis, severe nerve damage and severe bleeding if the arteries within the spinal column are penetrated.

Therefore, there is a need for a penetration resistant body armor that precludes penetration in order to protect those areas that are in the direct path of a penetrating implement thus preventing severe and/or fatal injury to the wearer.

BRIEF DESCRIPTION OF THE DRAWINGS

The invention is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

FIG. 1A is an isometric view of crossover points of a fabric.

FIG. 1B is an illustration of crossover points of a fabric with a tight weave.

FIG. 1C is an illustration of a sharp implement encountering the fabric of FIG. 1B.

FIG. 1D is an illustration of the failure of the implement of FIG. 1C.

DETAILED DESCRIPTION

Figure 2A:
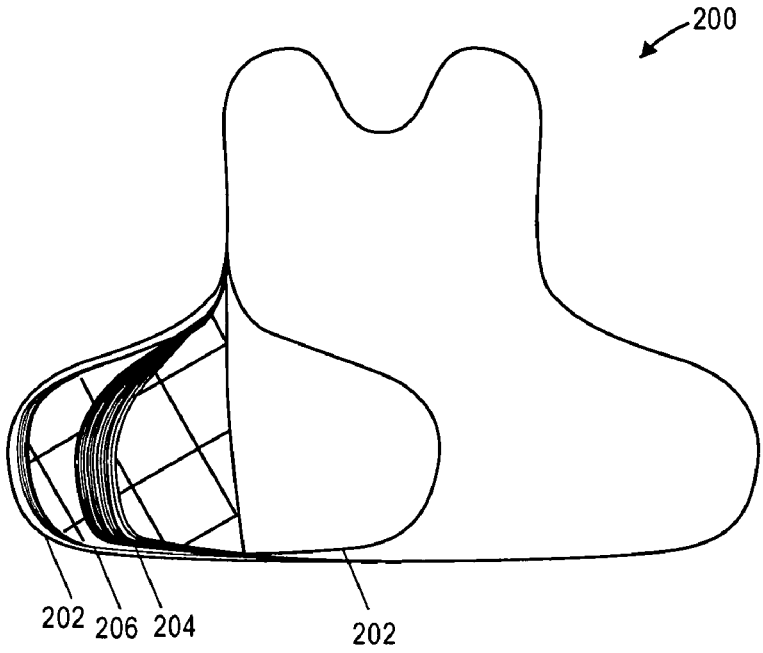
FIG. 2A is a cut-away plan view of a male penetration resistant body armor panel.

Stab resistant body armor is designed to do one primary function, which is to stop pointed or sharp object penetration (stab resistance) through a process relying on the tensile strength coupled with specific cross over pick counts of component fabrics that resist penetration through the weave or through the material itself by a "Cover Factor" and/or "Fabric Tightness Factor." Cover Factor is a term used to describe the density of the weave of a fabric. This density is defined as the value of the geometry of the weave calculated with the percentage of gross surface area of the fabric that is actually covered by the yarns of the fabric (not the voids between cross over points). Weave styles and their resultant pick counts or cross over points vary widely. It is very possible to have a low maximum cover factor even though the weave count is high or the fabric is woven tightly. The fabric tightness factor is a measure of the tightness of a specific fabric weave as compared to maximum tightness of the cover factor or the actual full material covering over a given fabric surface. These two factor equations are from the text (Weaving: Conversion of Yarns to Fabric, Lord and Mohamed, published by Merrow (1982), pages 141-143).

$D_w$=width of warp yarn in the fabric $D_f$=width of fill yarn in the fabric $P_w$—pitch of warp yarns (ends per unit length)

$P_f$=pitch of fill yarns $$Cw = \frac{Dw}{Pw} \quad Cf = \frac{Df}{Pf}$$

$$FabricCoverFactor = C_{fab} = \frac{totalareaobscured}{areaenclosed}$$

$$FabricTightnessFactor = \frac{actualcoverfactor}{maximumcoverfactor}$$

Exemplary fabrics include aramid fabrics with high tensile strengths and high resistance to penetration. This resistance to penetration comes from a combination of the aramid fabric's fiber tensile strength, elongation of yield, and selected pick count. Pick count is a measure of the number of threads of fiber in a given area of fabric. The greater the pick count the greater the number of threads in a given area the fabric has. A fabric with a high pick count may have a greater resistance to penetration than a fabric with an identical thread but a lower pick count.

In adjusting the denier and pick count of a fabric, care must be given to not place too may fibers with too high a denier in a given area. As denier increases, the diameter of the fiber increases. Increasing the denier of a fiber without reducing the pick count of the fabric may lead to crimping. Crimping occurs when the fibers are so tightly packed together at cross-over points the fibers cannot elongate. When crimping occurs there is no benefit gained from the fiber's ability to stretch. Thus, too high a denier combined with too high a pick count results in crimping and reduced efficiency of the fabric.

Similar fabric materials with different deniers and pick counts effectively make different material. This is because they will have different mechanical properties. Higher denier means there is more of the fiber per length of thread. This additional material gives the thread greater tensile strength. Greater tensile strength gives the fabric greater resistance to penetration. Higher pick counts mean there are more threads per area to be struck by the implement. These additional threads in higher pick count materials add their tensile strength to the resistance to penetration of the fabric. Due to the above mentioned relation between fiber denier and pick count, a higher denier fiber with a lower pick count may still have the same strength, but increasing the denier of the thread to increase tensile strength will cause the weight of fabric to increase.

There are other elements that have a significant effect upon the capability or incapability of a textile to preclude penetration. The elements may overcome even the best cover factors with or without the combined ratio of fabric tightness factors. These elements are related to the weapon itself and the methods of deployment.

There are three primary characteristics of a weapon and its use that affect its capability to penetrate an object:

1. size and shape
2. hardness
3. energy or amount of deliverable force applied to the weapon to drive its penetration.

Sharp pointed and round objects such as an awl or ice pick have very small pointed tips with minimal surface area to be resisted by a textile fabric. This eliminates the need for the implement to forcibly break the fabric fibers within the threads. The implement merely pushes the threads aside and slips through either the openings surrounding the weave crimp or through the fabric itself. Rigid plates, platelets, or resin impregnations aid in eliminating this type of penetration, and aid in single or double edged blade resistance. However, garments using these structures are heavy, less pliable and less comfortable to perform daily tasks in, for the wearer than purely fabric garments.

FIG. 1A depicts a very simple example of a plain woven textile that has been penetrated by a sharp pointed object slipping by or past a ply of textile fabric near the crossover point. The threads are literally pushed aside in all directions allowing the penetration. FIGS. 1B-C show a simplified attack of a pointed object as it is being thrust into a more tightly woven textile and the effects of the resistance of the fabric. FIGS. 1B-C show the tighter fabric with an increased weave count offering a greater cover and tightness factor over the surface of the fabric.

The FIG. 1C shows the implement being forced downward into the fabric. As the tightly woven fabric is forced downward by the implement it is actually pushing the fabric surface in direct contact with the tip to compress onto itself thereby increasing the resistance force opposing the implement's tip.

FIG. 1D shows how the fiber strength of the fabric exceeds the implement's material strength. The point of that implement fails to penetrate the fabric and becomes damaged in the process. This is typical of very pointed implements with insufficient cross-sectional density vs. shaft length, which is necessary to eliminate metallic fatigue or a flexure failure that is commonly associated with these types of weapons. A flexural failure is due to downward pressure being exerted to a point where the cross sectional density of the shaft starts to bend from the tension on one side increasing and the continued compression on the opposite side continuing until the metal shaft itself either bends due to its ductility or is broken due to the brittleness of its material. Some metals are designed to handle high forces or loads if the loads are applied gradually or gently, but this type of attack is very quick and instantaneously loaded from the various forces acting upon it.

FIGS. 1A-D illustrate how the cover factor and fabric tightness factors interplay to react to and resist penetration. When these factors are not sufficient to withstand an implement having a greater sectional density or an edged blade that cuts through the textile fabric as it is being thrust into the material, the material fails. Multiple plies or layers of fabric even if laid on top of each other in a stitched or non-stitched manner, each reach a point of fatigue and offer little or no resistance to penetration.

The National Institute for Justice (NIJ) has developed a standard for characterizing the stab resistance of personal body armor labeled NIJ Standard 0115.00. This standard specifies the minimum performance requirements for body armor that is resistant to a typical attack using a pointed or edged weapon. The highest level of protection defined by the NIJ 0115.00 includes a first energy level attack called "E1" and a second energy level attack "E2". At level E1 a maximum blade or spike penetration of seven millimeters is allowed. At level E2 a maximum blade or spike penetration of twenty millimeters is allowed. The strike energy of the E1 threat is forty three Joules and the strike energy of the E2 threat is sixty five Joules. The NIJ 0115.00 test of a stab resistant garment includes an attack perpendicular to the plane of the garment (zero degree from center attack) and a forty five degree angled attack from the plane of the garment.

Further reference will now be made to the drawings. In the following drawings, like structures are provided with like reference designations. In order to show the structure of the invention more clearly, the drawings included herein are diagrammatic representations of the indicated structures. Thus, the actual appearance of the fabricated structures, for example, in a photograph, may appear different while still incorporating the essential structures of the invention. Moreover, the drawings show only the structures necessary to understand the invention. Additional structures known in the art have not been included to maintain the clarity of the drawings.

FIG. 2 illustrates one embodiment of a front panel 200 of a protective garment. The front panel 200 of the protective garment includes a protective outer sleeve 202. In one embodiment, the protective outer sleeve 202 envelopes an outer layer 204 and an inner layer 206. The outer layer 204 is closest to the exterior of the garment and would be the first layer to resist an attack. In another embodiment, front panel 200 includes additional layers between inner layer 206 and the sleeve 202. The inner layer 206 and additional layers lie between the outer layer and the individual wearing the garment.

In one embodiment, protective sleeve 202 is a nylon fabric. The nylon fabric is composed of 200 to 400 denier material. The nylon protective sleeve 202 protects the enveloped layers from environmental factors such as direct sunlight that may adversely affect the strength or resistance properties of the fabrics in the enveloped layers. In one embodiment, the nylon sleeve 202 is treated to be water resistant. In another embodiment, the protective sleeve 202 is a Cordura® fabric, such as 500 denier Cordura® manufactured by DuPont® of Wilmington, Del. A protective sleeve 202 manufactured from Cordura® provides additional protection to the enveloped layers from heat and fire as well as ripping and tearing. In another embodiment, other fabrics with similar protective qualities are used to manufacture the protective sleeve 202.

Figure 2B:
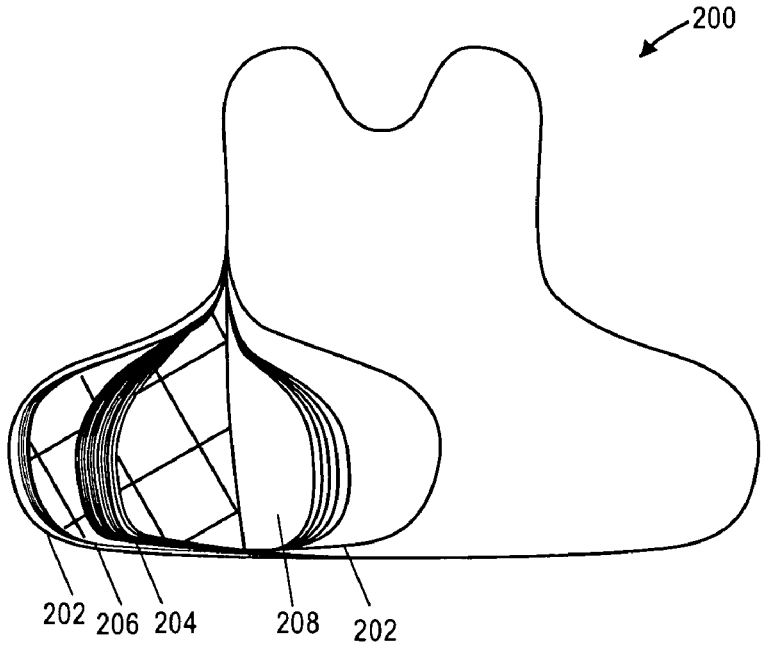
FIG. 2B is a cut away plan view of a male penetration resistant body armor panel.

FIG. 2B illustrates one embodiment of a protective garment. This embodiment may be similar to the embodiment illustrated in FIG. 2A with the addition of a third layer 208 having multiple plies.

Figure 3:
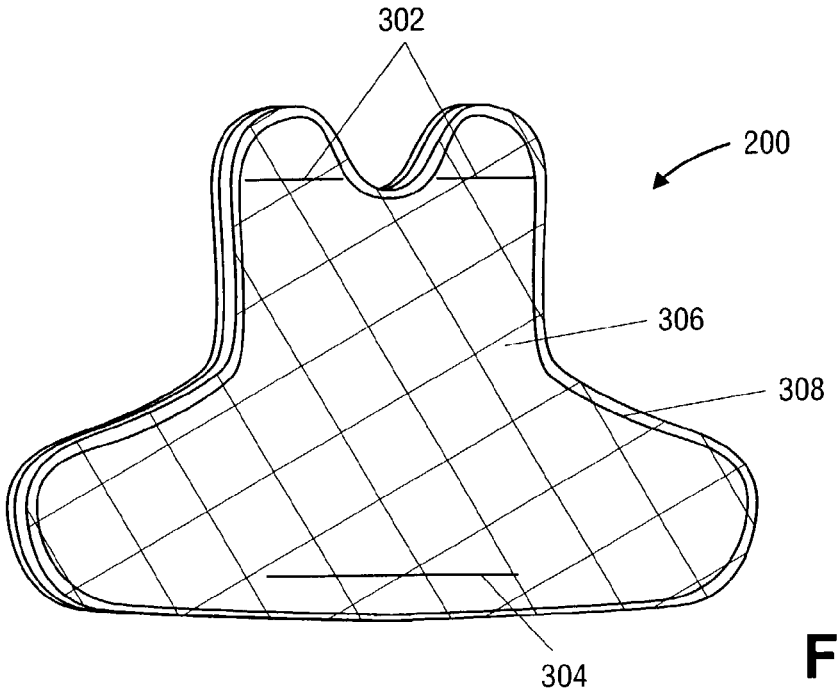
FIG. 3 is a plan view of a male penetration resistant body armor panel illustrating quilting, stitching and bar tack location.

FIG. 3 illustrates one embodiment of the enveloped layers of the front panel 200 of the protective garment. The outer layer 204 is visible as the top layer. The outer layer 204 includes bar tacking near the top of the garment near the shoulders 302 and near the bottom 304 of the garment. The bar tacking couples the outer layer 204 to inner layer 206. The bar tacking is constructed of an aramid thread (e.g., Kevlar® thread or similar material). The bar tacking is the only direct means by which these two layers are connected together. In another embodiment, additional layers are used and coupled to the outer layer 204 and inner layer 206 solely by means of the bar tacking 302, 304. The outer layer 204 includes multiple plies of fabric. In one embodiment, the outer layer 204 includes at least three plies of material. In one embodiment, the outer layer 204 includes approximately seventeen plies of fabric. The number of plies can be varied dependent upon the fabric used. The plies of fabric used in the outer layer 204 can be of a single fabric type or mixed fabric types. The plies of the outer layer 204 are quilted with diagonal cross-stitching 306 using an aramid thread (e.g., Kevlar® or similar material) through each ply of the outer layer 204. In one embodiment, the quilting is a two-inch field quilting pattern. The plies of the outer layer 204 are also held together with a perimeter stitching 308 also using an aramid thread. In another embodiment, other threads having a high tensile strength and cut resistant properties are used.

In one embodiment, inner layer 206 includes multiple plies of penetration resistant fabric. The inner layer 206 includes at least two plies. In one embodiment, the inner layer 206 includes approximately five plies. The plies of the inner layer 206 are quilted together using diagonal cross-stitching 306 and perimeter stitching 308 using aramid thread in the same manner as the outer layer 204.

In one embodiment, the plies of the outer 204 and inner 206 layers are an aramid textile, (e.g., Kevlar® Correctional including Kevlar® 159, 200, manufactured by DuPont®) with a plain weave, a warp count of seventy, a fill count of seventy, a nominal weight of 3.90 ounces per square yard, a nominal thickness of 0.18 inches, breaking strength in the warp of approximately 385 pounds per square inch, and in the fill of approximately 530 pounds per square inch. In another embodiment, other textile fabrics are used in place of or in combination with Kevlar® Correctional™. The outer layer 204 and inner layer 206 can be constructed with any fabric that exhibits sufficient tensile strength, elongation, cover factor, weave tightness or encapsulation of fibers or threads to preclude penetration of an implement through the front panel 200 of the garment. A combination of fabrics can be used to resist specific threats. For example, to resist single and double edged blades a fabric including steel yarn, having a satin weave with a nominal thickness of 0.3 mm to 0.50 mm, a weight range of from 620 grams per square meter to 2005 grams per square meter, a nominal fiber diameter of twelve micrometers+−three micrometers, with a warp count from twenty-five to fifty per inch and a weft count from twenty to fifty per inch can be used. Other textile fabrics and compositions that are suitable include but are not limited to aramids, para-aramids, polyethylene composite encapsulated fibers with zero degree and ninety degree orientations, resin impregnated aramids and coated aramids. Trade names commonly associated with these fabrics include but are not limited to TurtleSkin® Diamond coat™, TurtleSkin® Palm master™, TurtleSkin® Flex™, and TurtleSkin® Sport™, manufactured by Warwick Mills, Inc of New Ipswich, N.H.; Spectra Shield®, Spectra® Flex™, Spectra Shield® plus, Gold flex®, and Gold Shield®, manufactured by Allied Signal, Inc. Petersburg, Va.; Dyneema UD series unidirectional sheets including UD-SB21, UD-SB31, UD75-HB2, and UD-HB-25, manufactured by DSM High Performance Fibers, B.V. Netherlands; Kevlar® woven fabrics manufactured for weaving by DuPont® Fibers Kevlar® Products, Wilmington, Del.; Spectra® woven fabrics manufactured by Allied Signal, Inc. Petersburg, Va.; and PBO Zylon® manufactured for weaving yarns; or fabrics by Toyobo, Tokyo Japan, licensed from Dow Chemical, Inc. Midland, Mich. In addition, some lighter and heavier textiles using carbon fiber, E glass and S2 glass hybrids could be used. Hybridization of various materials improves resistance to a broader range of threats currently in use or not known at this time. One of ordinary skill in the art would recognize however that with adequate notice given to denier, pick count and elongation of failure, various materials might be substituted for the materials mentioned above.

In one embodiment, the front panel 200 illustrated in FIG. 3 is best suited for use by an adult male. Separate upper bar tacks 302 coupling together the layers provide complete protection from level E2 threats to the shoulder region. The bar tacking 302 and 304 prevents the individual plies and the layers from curling over, bunching up or separating. This makes the garment more durable over time, by maintaining the protective structure of the garment. Perimeter stitching if used alone tends to unravel over time with use allowing layers and plies to move, curl or separate. This diminishes the protective qualities of the garment.

Figure 4:
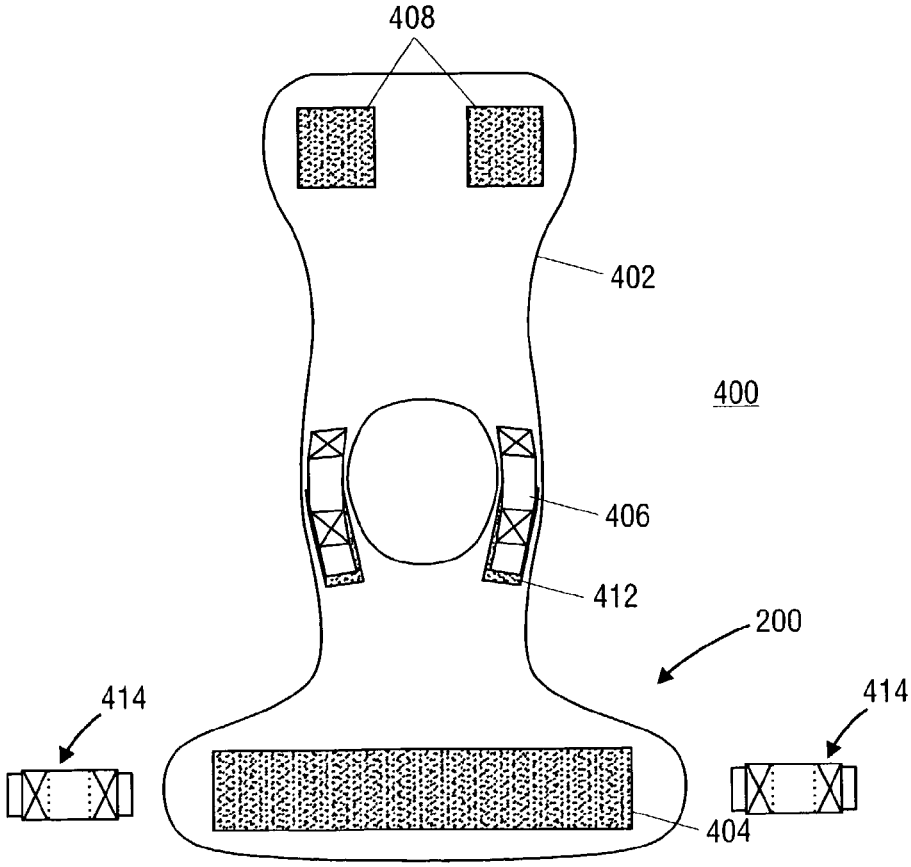
FIG. 4 is a plan view of a male penetration resistant body armor.

FIG. 4 illustrates a front panel 200 coupled to a back panel 402. In one embodiment, front panel 200 has an elongated waist section that wraps around an individual wearing the garment to protect the sides of the individual from an E2 level of attack. A Velcro® strip 404 along the elongated waist section couples to elastic adjustment straps 414. These straps 414 allow for adjustable coupling of the front panel 200 to the complementing Velcro® patches on the back panel thereby securely attaching the front and back panels at the waist. Velcro® strips and an elastic adjustment strap 406 can secure the front panel to the back panel at the shoulders, while providing means of adjusting the fit to the individual wearing the garment. In another embodiment, garment 400 can be manufactured as a single panel. In one embodiment, the adjustable straps 406 are removable. In another embodiment, the front panel 200 and back panel 402 are coupled together using Velcro®, snaps, buckles, D-rings, double D-rings or similar fasteners.

Figure 5B:
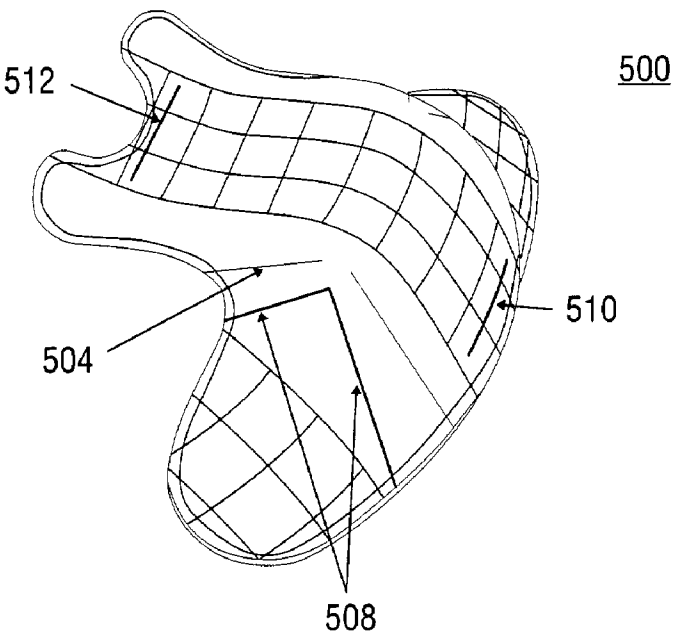
FIG. 5B is an isometric view of a female penetration resistant body armor panel.
Figure 5A:
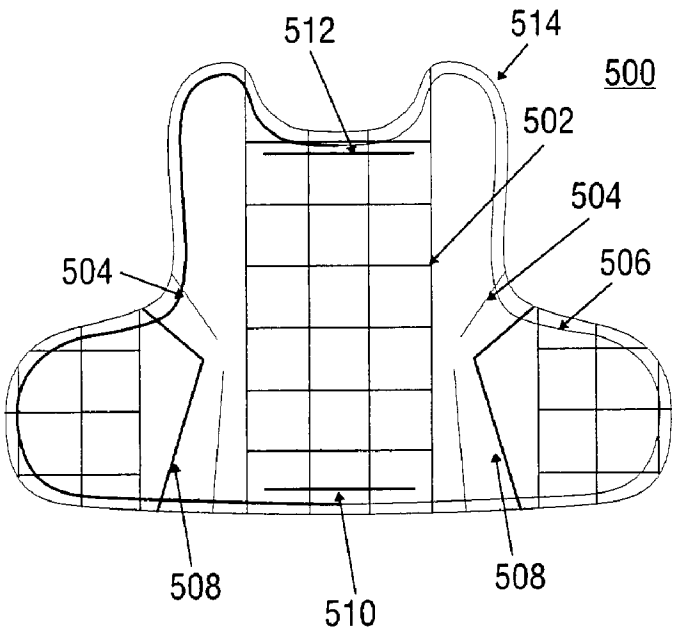
FIG. 5A is a plan view of a female penetration resistant armor panel illustrating seam, bar tacking and quilting location.

FIG. 5A illustrates one embodiment of a front panel designed to be worn by a woman. This front panel is designed to protect a woman's chest. A typical front panel offers inferior protection to a woman because a woman's breast would not allow the panel to lie flat resulting in diminished protection. Front panel 500 is designed to fit women of various breast sizes. The plies of outer layer 514 and are stitched together using an aramid thread (e.g., Kevlar® or similar material) with the two-inch field quilting 502 pattern illustrated in FIG. 5A. The plies of inner layers are stitched together in the same manner as the outer layer 514. The field quilting covers a rectangular vertical midsection and the side flaps of layer 514. Perimeter stitching 506 also couples the plies of the layers together. This allows greater flexibility for the fabric in the non-quilted regions to provide the cupped region for a wearer's breast. A dart seam 504 further defines the cupped region for an outer layer 514. A single upper bar tack 512 is used near the neck. The use of a single bar tack 512 prevents bunching of the layers in the shoulder region and improved fit for a woman. A bar tack 510 is used near the waist of the garment. Triangular bar tacks 508 couple the layers together to define the cupped region across the layers. The seams and overall size of the garment can be varied to accommodate various women's breast sizes comfortably. The fabrics and layers are otherwise similar to the variations used in the male front panel 200.

Figure 6:
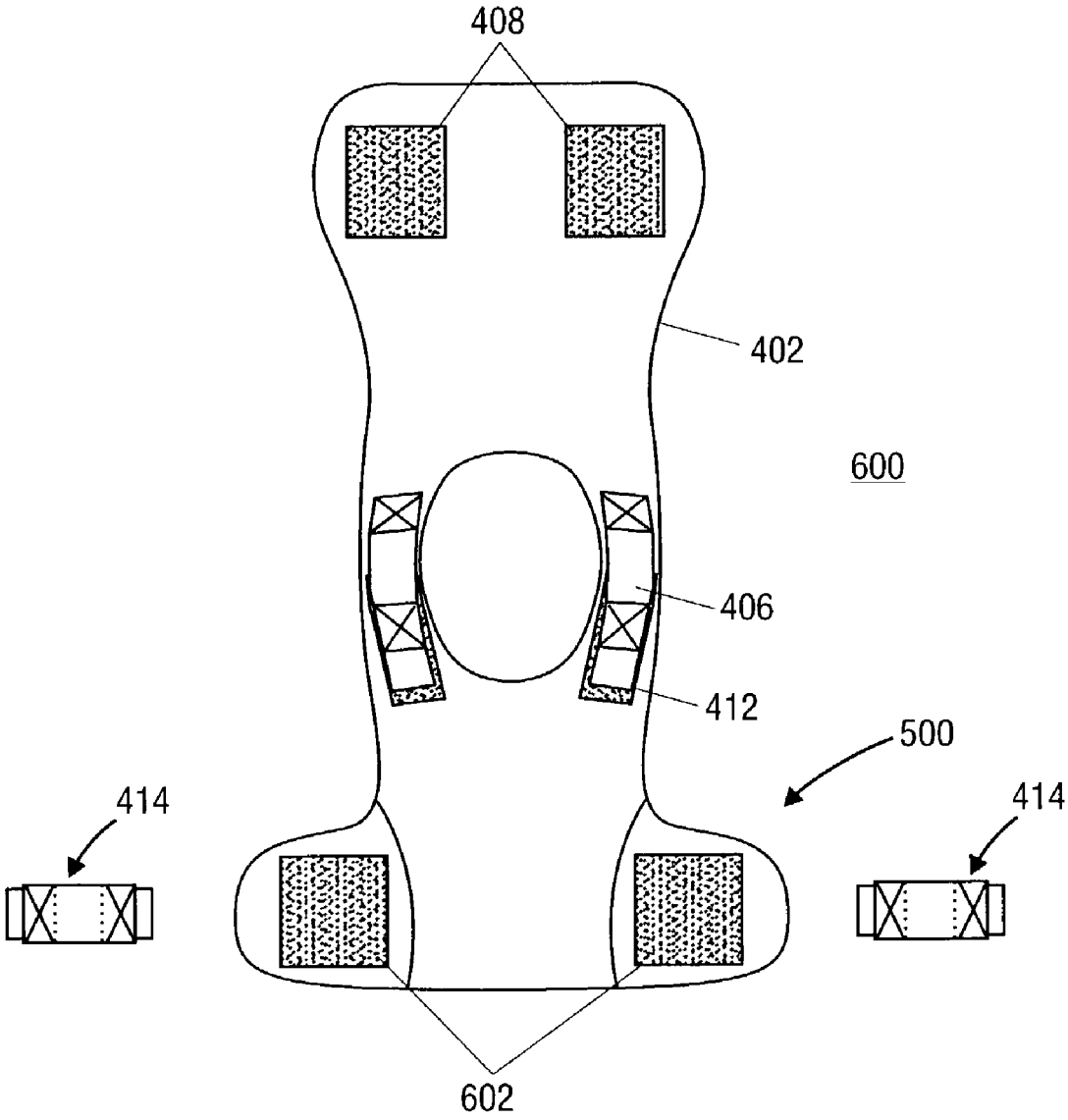
FIG. 6 is a plan view of female penetration resistant body armor.

FIG. 6 illustrates one embodiment of a woman's garment. The back panel 402 is of the same design as the back panel used in a man's garment. The front panel 500 includes separate Velcro® patches 602 to attach securely the front panel 500 via adjustable elastic straps 414 to the back panel 402, because of the outwardly curved midsection. In another embodiment, Velcro®, snaps, buckles, D-rings, double D-rings or similar fasteners are used to fasten the front and back panels at the waist. Shoulder adjustment straps 406, shoulder Velcro® patches 412 and back Velcro® patches 408 are similar to those used in a man's garment.

FIGS. 7A-E depict through several steps how the mechanisms that fail through their best resistant factors can be brought back to bear upon the thrusting implement. This is a process that can be utilized with the various types and grades of materials described above. Even materials that inherently fail with numerous plies work very well, when structured in an alternating stitched and free play manner.

Figure 7A:
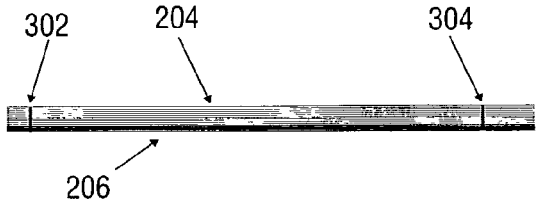
FIG. 7A is a cross-sectional view of a two-layer penetration resistant body armor.

FIGS. 7A through 7E illustrate the manner in which one embodiment, prevents an NIJ E2 threat from penetrating the garment. FIG. 7A shows a cross section of one embodiment of a front panel 200 including two layers. The sleeve 202 is not illustrated. Outer layer 204 includes approximately seventeen plies of Kevlar® Correctional™ or similar material. Inner layer 206 includes approximately five plies of Kevlar® Correctional™ or similar material. Outer layer 204 and inner layer 206 are attached by bar tacks 302 and 304.

Figure 7B:
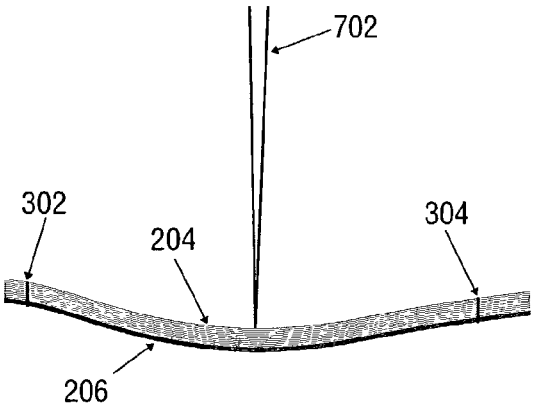
FIG. 7B is a cross sectional view of a two-layer body armor under pressure from a sharp implement.

FIG. 7B illustrates the outer layer 204 encountering a sharp implement 702 that qualifies as a NIJ E2 threat. Outer layer 204 and inner layer 206 flex together under pressure from the implement 702.

Figure 7C:
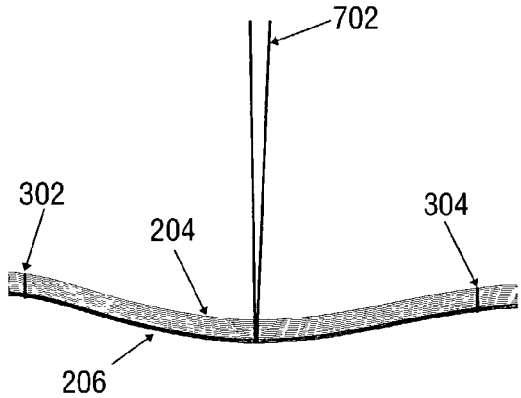
FIG. 7C is a cross-sectional view of a two-layer body armor with a layer penetrated by a sharp implement.

FIG. 7C illustrates the outer layer 204 failing under pressure from the implement 702 allowing the implement 702 to penetrate the outer layer 204 and come in contact with the inner layer 206. This takes a substantial amount of force as each ply of the outer layer 204 has an unmatched cross over point orientation to the next, and therefore offers as much cover factor as possible. As the implement 702 is forced to push its way through the outer layer 204 its shank becomes thicker and therefore the resistance against the shank of the implement 702 is increased. This is due to the weave crimping effect and tightness factor of the very tightly woven material being forced ever more tightly against the edges of material pressed outward and displaced by the shaft. A point is reached when the tensile strength and the cover factor fail to eliminate complete penetration of outer layer 204. Approximately, 80-85% of the energy of an E2 threat is expended to penetrate the first layer measured in terms of the implement's distance of movement over time.

Figure 7D:
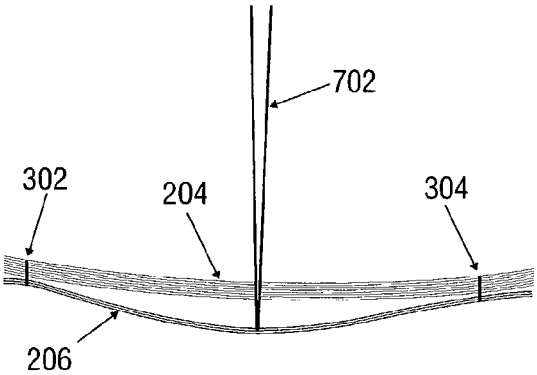
FIG. 7D is a cross-sectional view of a two-layer body armor with a layer penetrated by a sharp implement.

FIG. 7D illustrates the implement expending its remaining force to pressure the inner layer 206. The inner layer 206 is a densely formed layer that resists the implement 702 by being pushed away from the outer layer 204. Outer layer 204 separates from inner layer 206 and begins to exert lateral pressure on the implement 702, because it is attached to the stretched inner layer 206 by bar tacks 302 and 304. Outer layer 204 thereby provides continued resistance to the implement 702 by this lateral pressure caused by a combination of pressure on the inner layer 206 and the attachment of the outer layer 204 to the inner layer 206 via the bar tacks 302 and 304. This continues until the shaft of the implement 702 is forced to a point of resistance that does not allow the shaft forward movement at a rate that causes material slippage of outer layer 204 past the shaft 702. At this stage, the elasticity of the inner layer 206 reaches a point where the bar tacks 302 and 304 prevent further separation and the outer layer 204 is then drawn forward toward the inner layer 206. As this happens the shaft of the implement 702 starts dislodging from the outer layer 204 as the forced energy of the thrust is dissipated to a level where penetration through the inner layer 206 is not possible. The stitching in the inner layer 206 minimizes slippage of the implement point 702 through and around weave cross over points.

In one embodiment, additional layers (e.g., a third and forth layer, etc.) are attached to the inner layer 206 and outer layer 204 by the bar tacks 302 and 304. Additional layers aid in the reduction of penetration with increased weight. This alternating stitched and freeplay structure precludes penetration through the garment. This structure of layers with stitched plies and free play between layers defeats NIJ E2 threats including single and double edged blades. Edged blades cut and slice through materials weakening their structure, which aids in penetration of the materials. Loose non stitched plies of fabric are effective against blades because they allow the individual plies to slip and to resist penetration by reducing the tightness of a layer. However, once the plies reach a critical point of elongation they have less capability individually to resist the blade cutting through them. Thus, stitching that is overly tight aids an edged blade in slicing and cutting through a fabric. The alternation of the stitched layers with free play allowed by the bar tacked layers effectively prevents penetration by applying resistance, releasing resistance and then reapplying it through stretching and compression cycles of the fabric's ability to flex and rebound when configured in this manner.

Figure 7E:
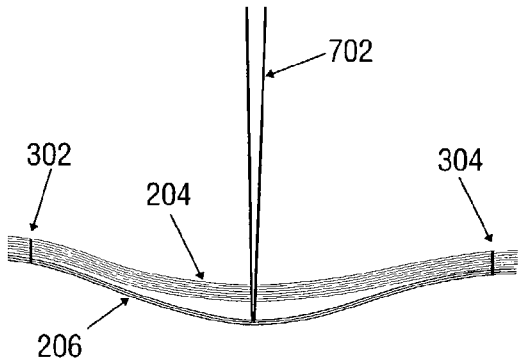
FIG. 7E is a cross-sectional view of a two layer body armor with a layer penetrated by a sharp implement.

FIG. 7E illustrates the failure of a NIJ E2 threat as it expends its remaining force on inner layer 206 and outer layer 204. Continued pressure on inner layer 206 by the implement 702 has increased the lateral pressure of outer layer 204 on the implement 702. The pressure of the outer layer 204 on the tapered implement 702 is of sufficient force to begin to push the implement out of the outer layer 204 causing the outer layer 204 to flex in toward the inner layer 206.

Table I demonstrates the resistance capacity of one embodiment including two layers of Kevlar® Correctional™ material in a nylon envelope. The first layer having 17 plies of Kevlar® Correctional™ and the second layer having 5 plies of Kevlar® Correctional™. This embodiment, does not allow any penetration of the garment by a spike driven at an NIJ E2 level. The NIJ 0115.00 standard allows a seven millimeter penetration for an E1 threat and twenty millimeters for an E2 threat. This test also requires the test specimen to be tested at a zero degree and forty five degree angle of impact. A forty five degree angle of attack is likely to cause increased cross-over point slippage by implement points, thereby aiding in the penetration of a tested garment.

TABLE I

| Implement Used | Energy level | Drop Height | Angle (deg.) | Penetration (mm) | Comments |
|---|---|---|---|---|---|
| SPIKE | E2 - 65 Joules | 11'8" | 0 | 0 | Spike Bent |
| SPIKE | E1 - 43 Joules | 7'8" | 45 | 0 | Spike Bent |

In one embodiment, the garment is lighter than other penetration resistant garments manufactured from the same materials using other standard garment structures. The garment is also softer, thinner, and much more pliable or flexible.

In one embodiment, the weight of the garment is 1.75 pounds for a male or female garment with 22 plies (17 plies in a first layer and 5 plies in a second layer) in two layers of Kevlar® Correctional™ material. The garment has a thickness of 0.196 inches, including a nylon sleeve 202, an outer layer 204 and inner layer 206. The garment including outer sleeve and two layers weighs 9.52 ounces per square foot of protected area.

In another embodiment, garments composed of plies of aramid fabrics have a weight in the range of 7.56 ounces to 8.42 ounce per square foot. These embodiments included two layers of aramid fabrics and prevent any penetration by an E2 spike implement threat. In another embodiment, layers having aramid fabrics and at least one steel mesh material including steel yarn have a weight in the range of 10.21 ounces to 13.54 ounces per square foot. These embodiments can prevent the penetration of an E2 spike or blade threat.

One embodiment of the garment includes a collar at the neck. The collar is a three inch collar that is stitched to the garment by an aramid thread or similar thread. The seam attaching the collar underlaps the neck collar by 1 inch into the neck region of the garment. This underlapping prevents a failure point along the attachment seam. The collar has similar layer structure to the front or back panels. In one embodiment, a two-inch quilting pattern is used. The neck collar prevents E2 threats from penetrating the garment including zero degree and forty five degree attacks to the neck.

In one embodiment, the garment includes a carrier garment that holds the sleeved layers of protective fabric. Carrier garments include vests, jackets, coats and similar garments. In one embodiment, the carrier garment includes dart seams to form a cupped region. This embodiment improves the fit and protection for a female user. Dart seams are aligned across plies, layers, the enveloped sleeve and the carrier garment such that the folds made in forming the dart seams are made in alternating directions in adjacent material to prevent a bunching of material. This alternating of the dart seams reduces the stiffness of the garment and prevents complete penetration by an E2 threat at the dart seam.

In the preceding detailed description, the invention is described with reference to specific embodiments thereof. It will, however, be evident that various modifications and changes may be made thereto without departing from the broader spirit and scope of the invention as set forth in the claims. The specification and drawings are; accordingly, to be regarded in an illustrative rather than a restrictive sense.

What is claimed is:

1. A protective garment comprising:

a first layer having a plurality of plies including at least one penetration resistant fabric coupled together by field quilting; and a second layer having a plurality of plies including at least one penetration resistant fabric coupled together, wherein the first layer is coupled to the second layer by at least one bar tack near a top and at least one bar tack near a bottom of the garment, and wherein the garment defeats at least a National Institute of Justice 0115.00 E2 threat.

2. The garment of claim 1, wherein the plies of the first layer are further coupled together with a perimeter stitch.

3. The garment of claim 1, wherein the first layer and second layer are enclosed in a protective sleeve.

4. The garment of claim 1, wherein the at least one bar tack near the top is two separate bar tacks near each shoulder.

5. The garment of claim 1, further comprising a dart seam to define a cupped region.

6. The garment of claim 1 further comprising:

at least one bar tack to define a cupped region.

7. The garment of claim 1 further comprising:

a third layer having a plurality of plies including at least one penetration resistant fabric coupled together.

8. The garment of claim 1, wherein the ply count of all layers is less than 23.

9. The garment of claim 1, wherein the weight of the garment is less than 10.0 ounces per square foot of a protected area.

10. The garment of claim 1, wherein at least one ply of the first layer is a cut resistant fabric.

11. The garment of claim 1, wherein the first layer and second layer are only coupled together via the at least one bar tack.

12. The garment of claim 1, wherein the garment defeats E2 threats with no penetration of the garment.

13. A method of making a protective garment comprising:

coupling together a plurality of plies including at least one penetration resistant fabric by field quilting to form a first layer;

coupling together a plurality of plies including at least one penetration resistant fabric to form a second layer;

coupling the first layer to the second layer via at least one bar tack near a top and at least one bar tack near a bottom of the garment, wherein the garment defeats at least a National Institute of Justice 0115.00 E2 threat.

14. The method according to claim 13 wherein the garment prevents any penetration through the garment by at least an E2 threat.

15. The method according to claim 13, wherein the plies of the first layer are further coupled together with a perimeter stitch.

16. The method according to claim 13 further comprising:

enclosing the first and second layers in a protective sleeve.

17. The method according to claim 14, further comprising:

placing a dart seam in the protective sleeve to define a cupped region.

18. The method according to claim 13, further comprising:

coupling the first and second layers with a bar tack to define a cupped region.

19. The method according to claim 13, wherein at least one ply of the first layer is a cut resistant fabric.

* * * * *